US010408567B1

(12) United States Patent
Carver, II

(10) Patent No.: US 10,408,567 B1
(45) Date of Patent: Sep. 10, 2019

(54) MODULAR MISSILE LAUNCHER

(71) Applicant: William R. Carver, II, King George, VA (US)

(72) Inventor: William R. Carver, II, King George, VA (US)

(73) Assignee: The United States of America as represented by the Secretary of the Navy.

( * ) Notice: Subject to any disclaimer, the term of this patent is extended or adjusted under 35 U.S.C. 154(b) by 0 days.

(21) Appl. No.: 16/369,240

(22) Filed: Mar. 29, 2019

(51) Int. Cl.
*F41F 3/04* (2006.01)
*F41F 3/042* (2006.01)
*F41F 3/077* (2006.01)

(52) U.S. Cl.
CPC ..... *F41F 3/042* (2013.01); *F41F 3/077* (2013.01)

(58) Field of Classification Search
CPC ..... F41F 3/00; F41F 3/04; F41F 3/042; F41F 3/045; F41F 3/0406; F41F 3/065; F41F 3/077
See application file for complete search history.

(56) References Cited

U.S. PATENT DOCUMENTS 3,425,586 A * 2/1969 Petters ..... B65D 21/0201 220/23.4
5,115,711 A * 5/1992 Bushagour ..... F41F 3/042 89/1.816
2015/0345900 A1* 12/2015 Sisemore ..... F41F 3/073 89/1.8

FOREIGN PATENT DOCUMENTS

DE 1946534 A1 * 3/1971 ..... F41F 3/04
EP 0308343 A1 * 3/1989 ..... F41F 3/04
EP 0935118 A2 * 8/1999 ..... F41A 19/65
GB 2324593 B * 12/1999 ..... F41F 3/0413

* cited by examiner

*Primary Examiner* — Gabriel J. Klein
(74) *Attorney, Agent, or Firm* — Gerhard W. Thielman, Esq.

(57) ABSTRACT

A modular canister is provided for containing a missile for launch. The canister includes a set of four longitudinal assemblies, an electronics module, and a hatch module. The assemblies are attachable to form a rectangular cross-section chamber between fore and aft ends. Each assembly includes a wall extrusion and a corner extrusion. The electronics module connects to the chamber at the breech. The hatch module connects to the chamber at the muzzle. The hatch module includes an aperture cover, a door and a hinge. The door pivots on the hinge between a default closed position and a command open position. The chamber can receive or else launch the missile through the muzzle when the door is in the open position.

11 Claims, 7 Drawing Sheets

MODULAR MISSILE LAUNCHER

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to missile canisters. In particular, the invention relates to modular construction of missile launchers for interchangeability.

Missiles are commonly transported to battlefields within canisters to avoid environmental exposure and cushion against vibration damage. Such canisters must withstand structural loads related to the mass of the missile contained therein, as well as pressure and thermal loads imposed from the rocket booster designed to propel the missile towards its target. Additionally, shielding from electromagnetic interference (EMI) can be a design consideration.

SUMMARY

Conventional missile canisters yield disadvantages addressed by various exemplary embodiments of the present invention. In particular, various exemplary embodiments provide a modular canister for containing a missile for launch. The canister includes a set of four longitudinal assemblies, an electronics module, and a hatch module. The assemblies are attachable to form a rectangular cross-section chamber between fore and aft ends. Each assembly includes wall and corner extrusions. The electronics module connects to the chamber at said aft end. The hatch module connects to the chamber at the fore end. The hatch module includes an aperture cover, a door and a hinge. The door pivots on the hinge between a default closed position and a command open position. The chamber can receive or else launch the missile through the aperture cover when the door is in the open position.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

The disclosure generally employs quantity units with the following abbreviations: length in feet (ft, '), inches (in, ") or meters (m), mass in kilograms (kg), time in seconds (s), angles in degrees (°), force in newtons (N), and temperature in kelvins (K). Supplemental measures can be derived from these, such as density in grams-per-cubic-centimeters ($g/cm^3$), moment of inertia in gram-square-centimeters ($kg\text{-}m^2$) and the like.

Figure 1A:
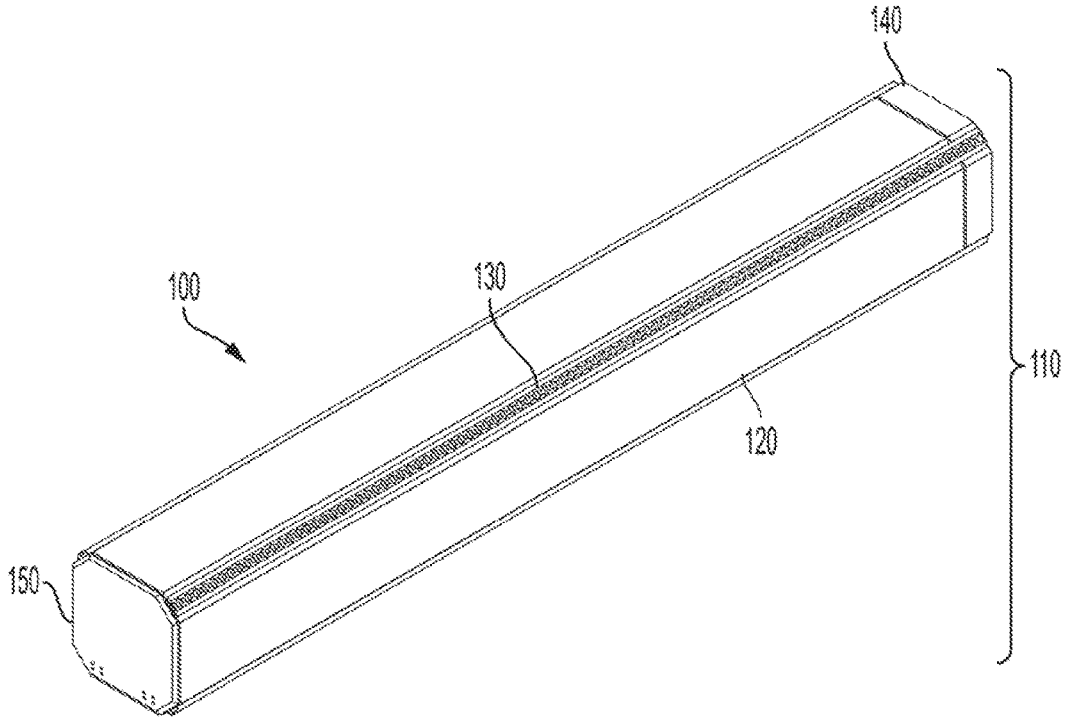
FIGS. 1A and 1B are isometric views of an exemplary square cross-section missile canister.
Figure 1B:
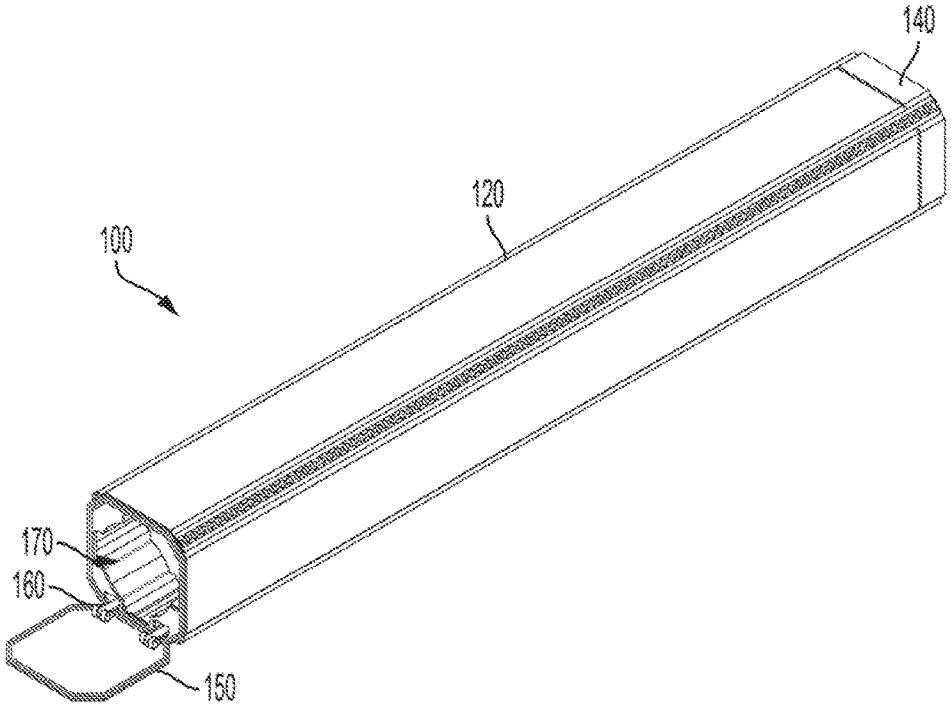

FIGS. 1A and 1B show isometric assembly views 100 of a modular missile canister 110, respectively closed and open. The exemplary square-cross-section canister 110 comprises four longitudinal panels 120 that form the walls, joined together at corresponding corner seams 130. The canister 110 includes an electronics module 140 and a launcher door 150 that attaches to one panel 120 by hinges 160. The door 150 opens to expose a longitudinal interior 170 for containing a contents package, such as a missile or other payload. The electronics module 140 constitutes an end cap. The canisters 110 form a 9"×9" cross-section, with panels 120 extending 4' (or 48") in length.

Figure 2:
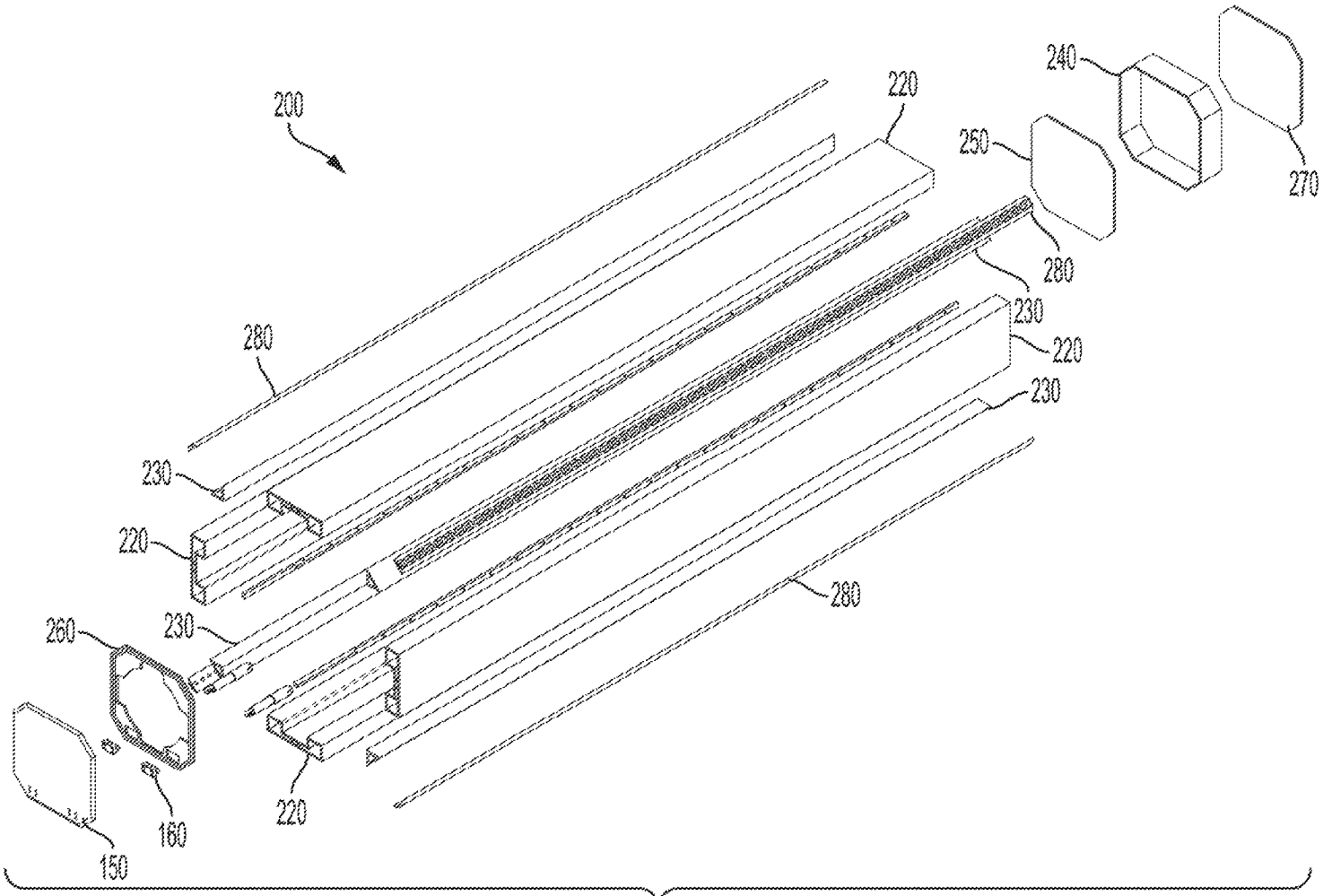
FIG. 2 is a first isometric exploded view of missile canister components.

FIG. 2 shows a first isometric exploded view 200 of components for the canister 110. The longitudinal panels 120 are composed of an example C-shape wall extrusions 220 longitudinally aligned in cruciform pattern and joined together at their seams 130 by corner extrusions 230 that extend parallel and diagonally adjacent to the wall extrusions 220. Each corner extrusion 230 has a right-isosceles triangular cross-section. The canister 110 is closed opposite the door 150 by a breech panel 250 to physically isolate the electronics module 140 from the contents package. The breech panel 250 may include isolated passageways for electronics connections between the canister 110 and the module 140 to conduct therethrough.

Opposite-facing wall extrusions 220 are uniform, whereas adjacent wall extrusions 220 may but need not have the same width. With customized wall extrusions 220, the canister 110 forms a rectangular chamber to accommodate axi-symmetric and non-axisymmetric munitions. The door 150 attaches to a muzzle 260 by the hinges 160. The muzzle 260 features a diagonal aperture to enable the missile or other payload housed in the canister 110 to pass therethrough, whether for load deployment or launch.

The electronics module 140 comprises an octagonal frame 240 closed by an aft panel 270, although this configuration is merely exemplary and not limiting. Each corner extrusion 230 has a triangular cross-section that receives within the flanking boundaries an exterior rail 280 that can be altered to a different type of rail depending on requirements. The alterations to the exterior rail 280 can include cross-section and/or corrugation geometry. For example, the exterior rail 280 can form a logistics-track (or L-track) pattern.

Figures 3A, 3B, 3C:
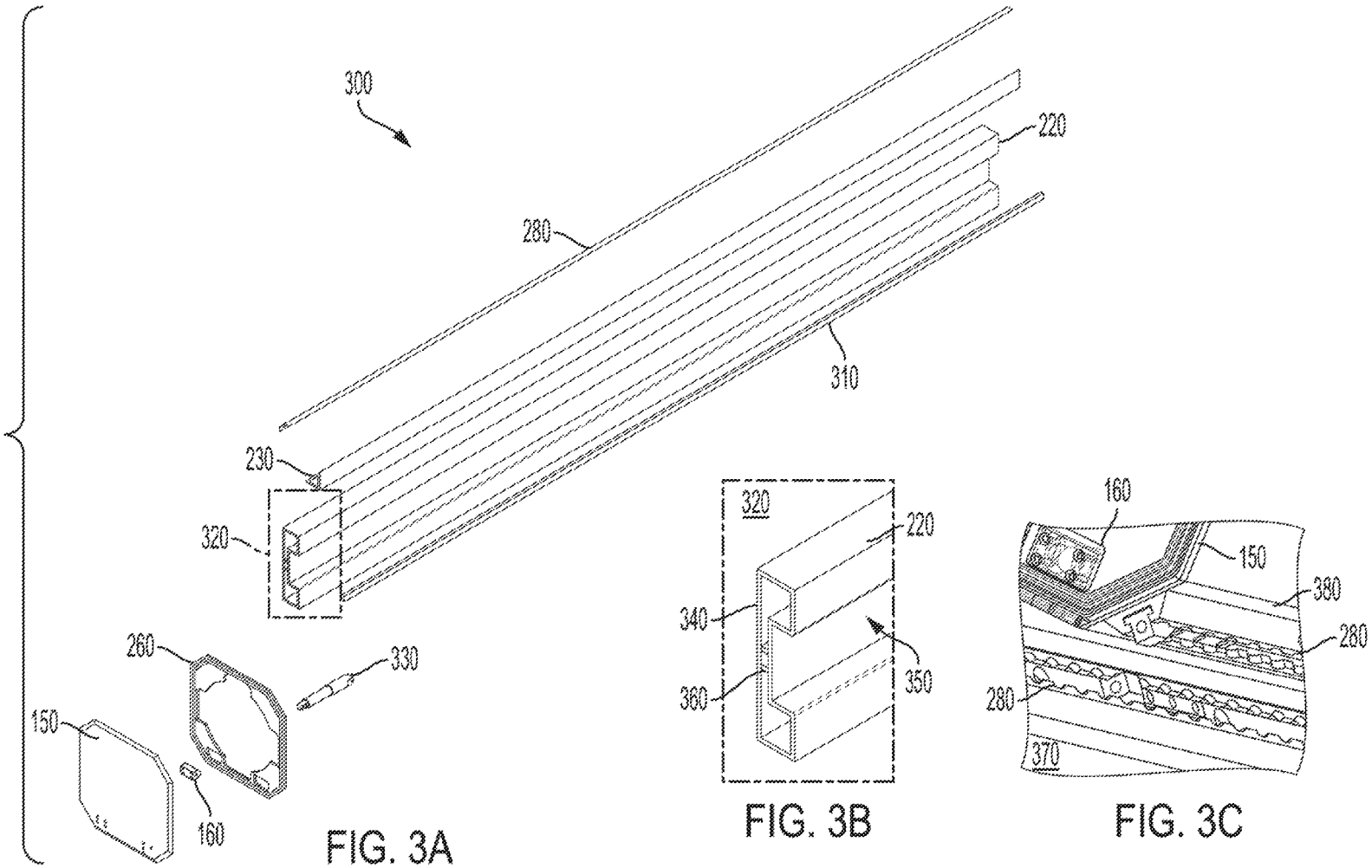
FIG. 3A is a second isometric exploded view of missile canister components.
FIG. 3B is an isometric detail view of a wall extrusion cross-section.
FIG. 3C is an isometric detail view of a pair of canisters prior to attachment by a mating track.

FIG. 3A shows a second isometric exploded view 300 of select components. Each wall extrusion 220 can include an interior rail 310, with larger wall extrusions 220 permitting multiple rails, dependent upon requirements and content configuration. An isometric detail view 320 provides additional geometry for the wall extrusion 220. A linear actuator 330 is disposed within the canister 110 for pivoting the hinge 160 to either open the door 150 by pushing or close the door 150 by pulling.

The exterior rail 280 conforms to an L-track per MS3360 standard. The interior rail 310 denotes a Picatinny rail per MIL-STD-1913, which provides an attachment-and-retention mechanism to the canister 110 for the missile or payload. Venders for sundry weapons may incorporate alternative interface geometries for interior rail 310, which can be exchanged for the compatible attachment as expedient. The external and internal rails 280 and 310 attach to the corner extrusion 330.

FIG. 3B shows an isometric detail view 320 of the wall extrusion 220, which incorporates a C-shape cross-section with an outer panel 340 and an inner channel 350 facing the interior 170 of the canister 110. An optional stiffener rod 360 extends between the channel 350 and the outer panel 340 of the wall extrusion 220 for structural reinforcement against transport and launch loads while providing material for attaching to the interior rail 310.

The channel 350 can also house the hatch actuators 330 to pivot the door 150 as well as enable cables and insulation outside of the missile or payload area, while also adding rigidity (by its double wall) and ballistic protection. The C-shape cross-section can be modified for larger canisters for increased strength, provided the exterior dimensions of the panel 340 match its opposite side.

FIG. 3C shows an isometric detail view 370 of two launchers close to attachment with example mating connectors; the attachment plate is not shown. The exemplary exterior rails 280, in this instance L-track, attach to the corner extrusions 230 of each canister 110 and contain a mating connector 380. A mating plate, not shown, can attach to each mating connector, joining adjacent canisters 110 together.

Figure 4:
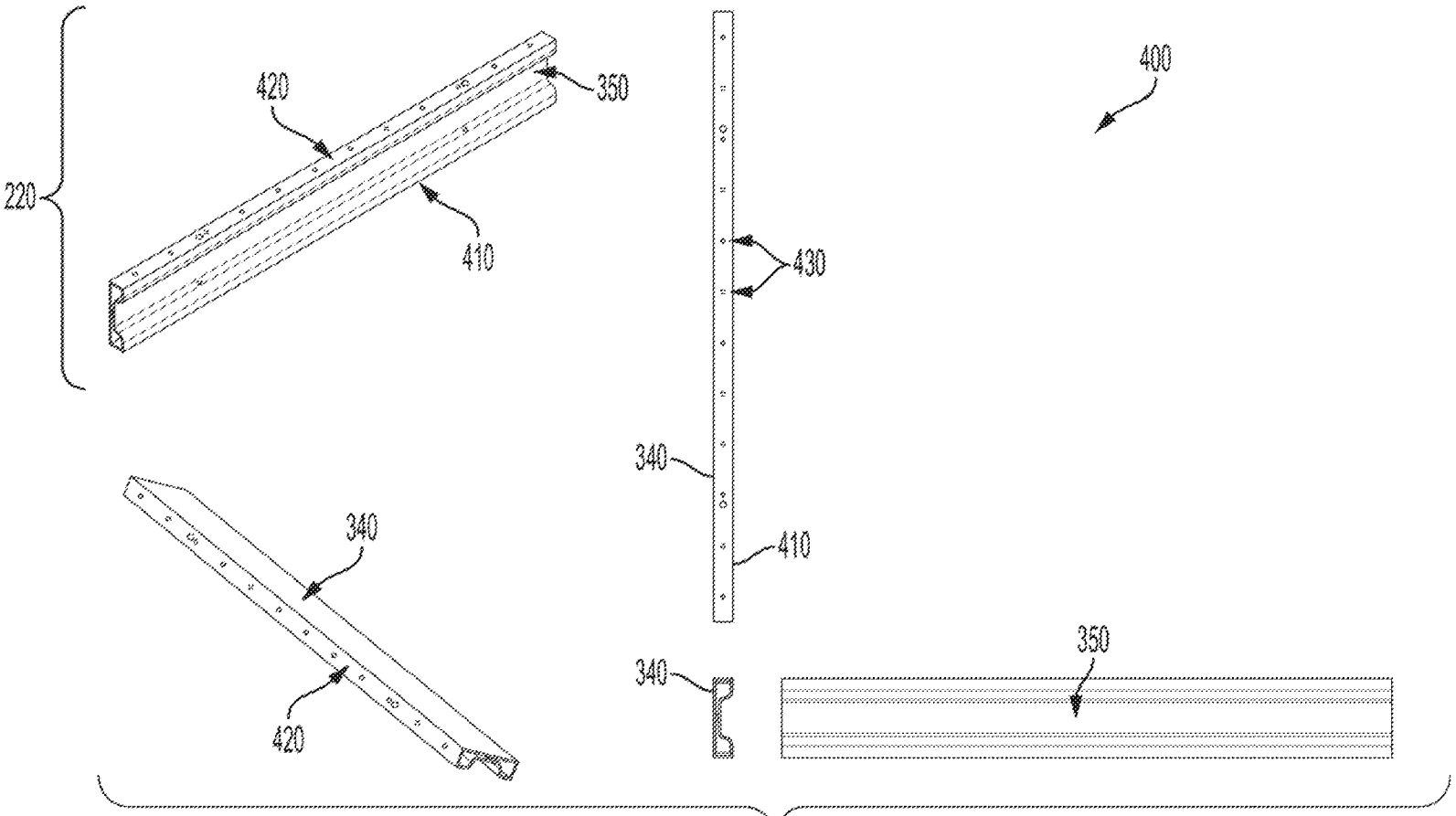
FIG. 4 is a set of plan and elevation views of a wall extrusion.

FIG. 4 shows a set of plan and elevation views 400 of the wall extrusion 220, together with two adjacent isometric views. The channel 350 is flanked opposite the outer panel 340 by inner panels 410 and connects to the outer panel 340 by perpendicular end plates 420, which includes through-holes 430 for attaching to the adjacent seam 130.

Figure 5:
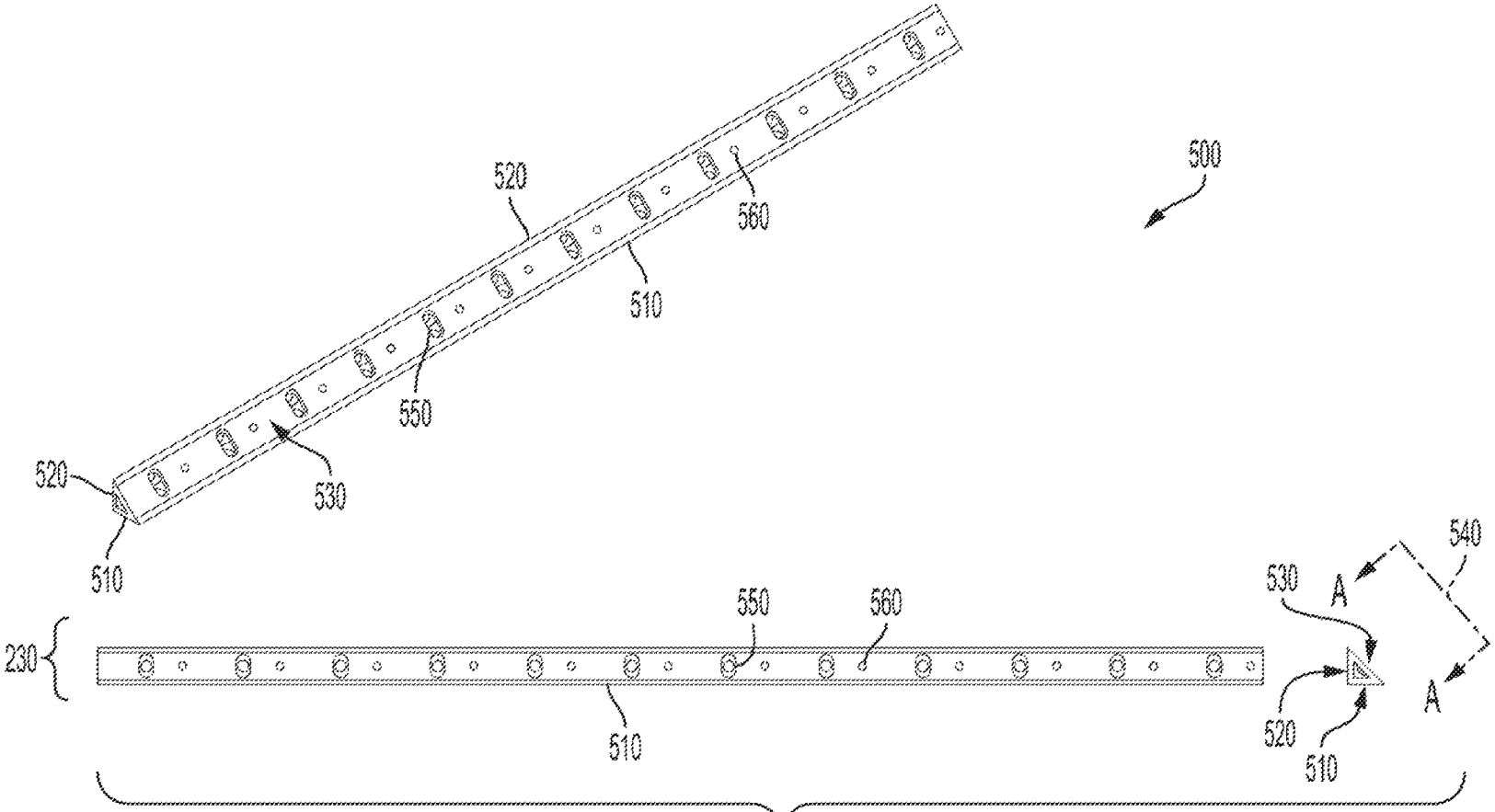
FIG. 5 is a set of plan and elevation views of a corner extrusion.

FIG. 5 shows a set of plan and elevation views 500 of the corner extrusion 230. The right-triangular cross-section is formed by a left side 510, a right side 520 and a diagonal side 530. Shallow cavities 550 filled with EMI gasket material are distributed as a regularly spaced set along the diagonal side 530, together with adjacent through-holes 560 for attaching to its corresponding exterior rail 280. A diagonal view A-A illustrates the diagonal side 530 of the corner extrusion 230 facing outward. The through-holes 430 and 560 are typically about ¼" in diameter and can be configured to receive bolts and/or rivets. EMI insulation can also be applied to the door 150 and the channels 350.

The seam 130 is formed from the exterior rail 280 and the corner extrusion 330 as an edge between adjacent perpendicular panels 120. The exemplary design incorporates a common hole size and spacing of these holes 560 to enable rails 280 and 310 to be manufactured that would fit their corner or wall extrusions 330 and 320. Conventionally, these hole spacings are the same throughout with the electronics modules 140, being secured by the exterior rails 280. Additional holes can be provided near the electronics module 140 for the interior rail 310.

Figure 6A:
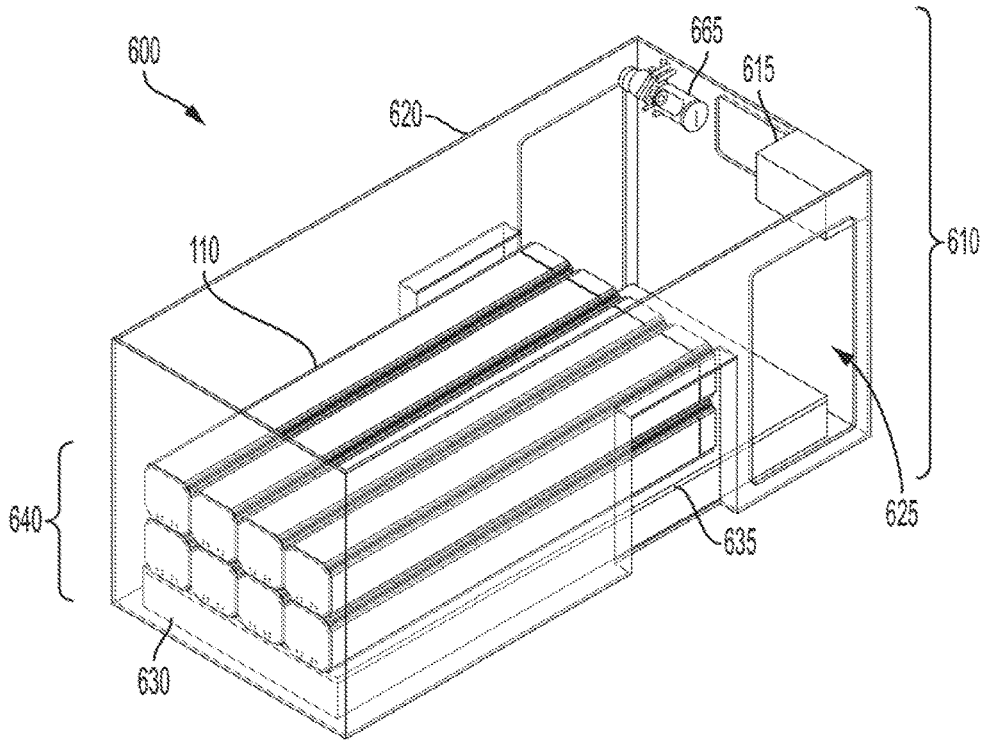
FIGS. 6A and 6B are isometric views of a launcher platform.
Figure 6B:
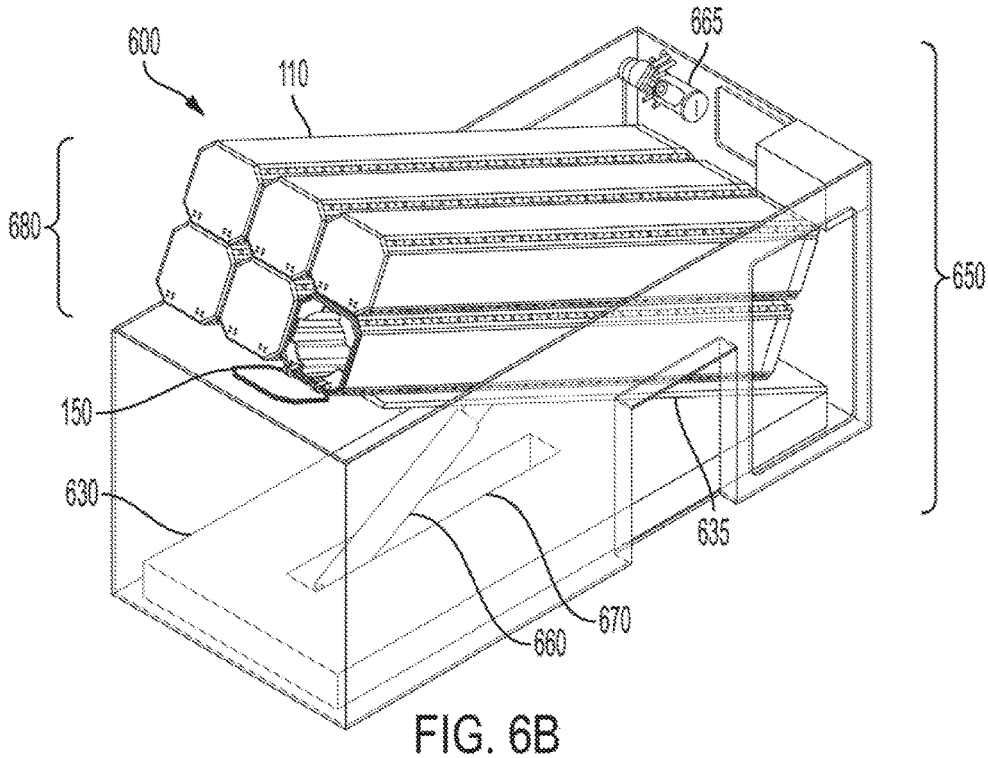

FIGS. 6A and 6B show isometric assembly views 600 of an exemplary launcher system. FIG. 6A illustrates the launcher 610 as stowed with an exemplary set of eight canisters 110 as stowed monitored and actuated by a controller 615 within a housing 620 accessible through flanking hatches 625. The canisters 110 are disposed above a platform 630 and atop an elevation panel 635 that contains rails at a specified spacing, together forming a stowed launch assembly 640.

FIG. 6B illustrates the launcher 650 as deployed. A launch actuator 660, mechanically extended by a hydraulic pump 665, is maintained within a recess 670 of the platform 630. The optional pump 665 can be substituted via electromechanical power. The actuator 660 pivots the panel 635 and thereby raises the azimuth of the canisters 110 as an elevated launch assembly 680 to launch a missile within a canister 110.

Aggregating multiple missile types has been suggested for various missions into modular and interchangeable assemblies. Typical conventional systems are built and geared toward a specific missile or missile family. These system assemblies entail constraints due to adaptation with existing interface hardware that limit configuration flexibility, adaptability and operational maintenance and repair.

Figure 7A:
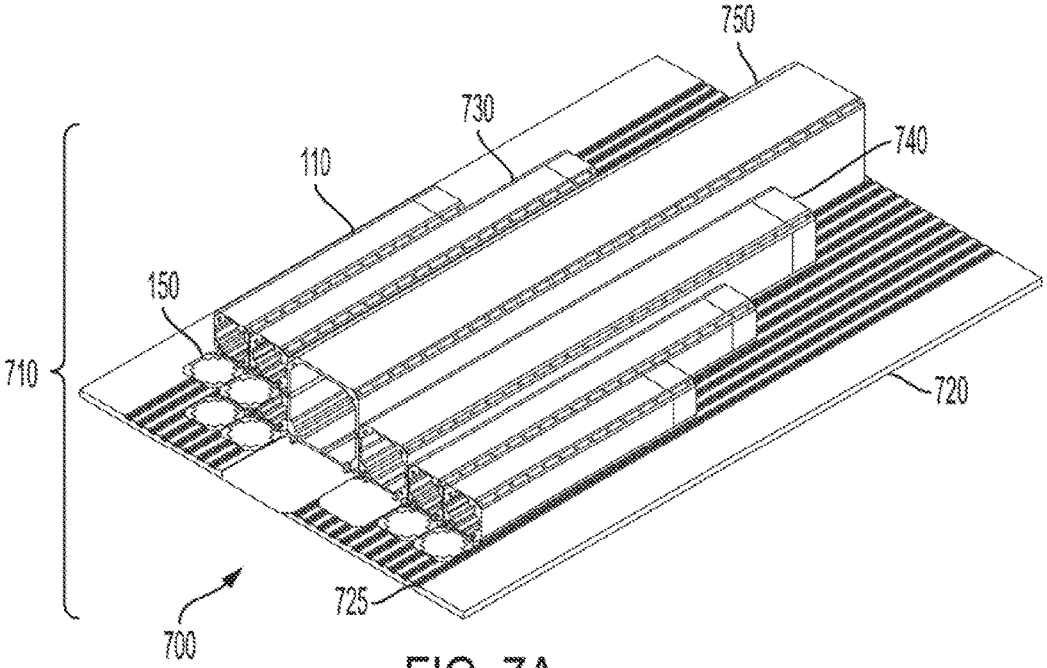
FIGS. 7A and 7B are isometric views of multiple modular launchers.
Figure 7B:
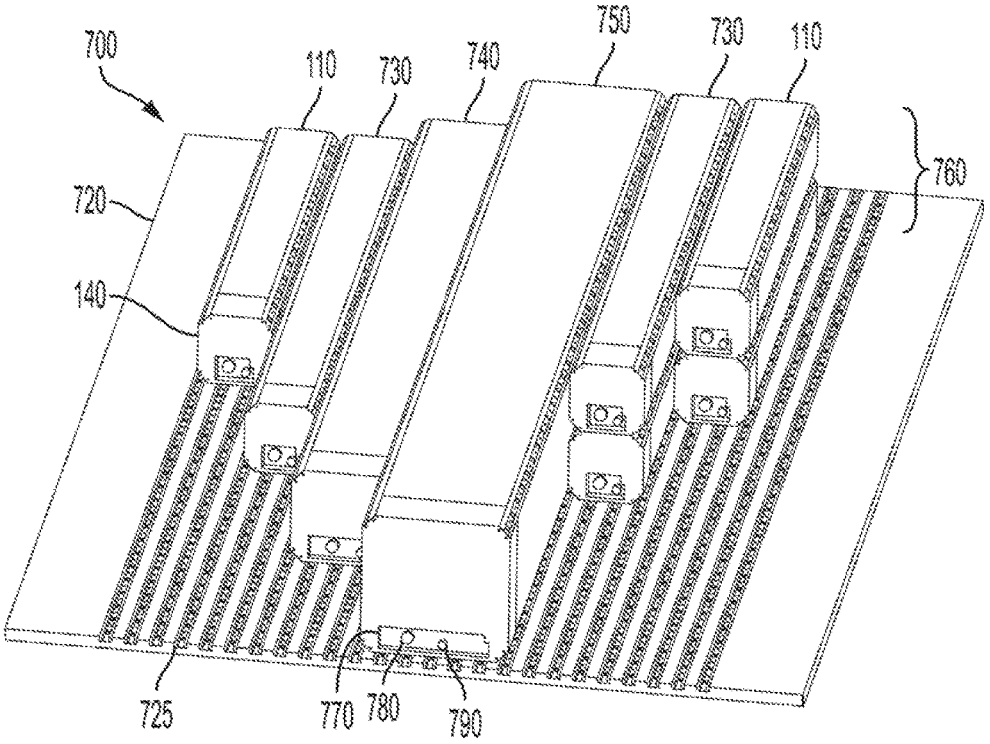

FIGS. 7A and 7B show isometric assembly views 700 of an aggregate assembly 710 showing respective fore and aft ends of canisters having various sizes. A platform 720 with rails 725 anchors the exemplary canister 110 and a longer canister 730 both having 9"×9" cross-sections. The respective lengths of the canisters 110 and 730 are 4' (48") and 6' (72").

Also shown on the platform 720 are larger canisters 740 and 750, composed of wider and longer panels than for the exemplary canister 110. The large canister 740 has a 12"×12" cross-section and an 8' (96") length. The extra-large canister 750 has an 18"×18" cross-section and a 10' (120") length. Non-axisymmetric missiles can be accommodated by panels 120 with different adjacent widths, while same widths as their opposite counterpart, such that the interior 170 has a rectangular cross-section. Canisters 110 can be disposed atop of another as a stack 760. The electronics module 140 with aft panel 270 can include an electronics interface 770 with a payload connector 780 and a monitor connector 790. These connectors 780 and 780 enable communication within the electronics module 140.

The electronics module 140 provides an interface to the payload (e.g., missile) for receipt of information or command instruction. The electronics therein would also control the actuators 330 for opening or closing the door 150. Monitoring components in the electronics module 140 can include low-power circuits along with temperature and humidity sensors (e.g., DHT22) and/or vibration shock sensors (SW420). These sensors could be queried intermittently to reduce power consumption, or continuously. The hinge position of the door 150 can be monitored in the electronics module 140 to ascertain whether physical tampering had occurred.

The payload connector 780 can be configured in accordance to MIL-STD-1760, while the monitor connector can be used to verify compliance with safety board requirements. Launcher electronics can be powered by a battery system in compliance with a BB-2590 or similar safety board approved battery in accordance to MIL-PRF-35052 for the power supply. External power supplies may be used during a charge cycle, or while the canister 110 is in storage.

The mating connector of the top canister 110 is disposed near the hatch door 150, whereas the other mating connector is somewhere along the exterior rail 280 of the bottom canister. This provides detail into stacking and attachment of different sized canisters 110 and their attachment. The attachment method also shows flexibility of angles of attachment with the mating connectors being at 90° (=π/2 radians) to each other in this detail view 370. Attachment to a larger canister may result in a mirror of the mating connector, or else attachment to the platform 720 could result in an angle of 45° (=π/4 radian) to the opposite mating connector.

The components can be preferably composed from 6061 aluminum alloy for extrusions such as the wall 220, corner 230, external rail 280 and internal rail 310. Additionally, the flat plates, such as door 150 and panels 250, 260 and 270 can be readily milled from ductile material such as aluminum alloy. Combined with the electronics module 140, the exemplary canister 110 (at 54" length) composed of aluminum alloy has a mass of 80 $lb_m$. Similarly, the longer canister 730 (at 78") is 120 $lb_m$, the large canister 740 (at 102") is 180 $lb_m$, and the extra-large canister 750 (at 126") is 305 $lb_m$. Alternatively, carbon fiber can be used for composition to reduce weight, albeit with more elaborate fabrication techniques. Various grades of steel can also be used as the selected material.

Reuse of a canister module 110 or its components for multiple missions (as well as facilitate remote environmental monitoring) could reduce cost and add capability to both the platform 720 and the module without necessitating a new design. Most conventional canister systems for housing munitions (including missiles) employ unique connectors, messages, voltages, etc., that must then drive specific designs of software, control boxes, etc. Most conventional launcher systems lack instrumentation to monitor missile life except through the missile itself and only when powered, with no security or tampering awareness. This monitoring limitation leaves gaps regarding conditions the munition has experienced during transportation and stowage.

Exemplary embodiments provide the advantage of modularity, adaptation, scalability, plug-and-play installation, and lifecycle monitoring. These features improve the usefulness of the separate components and reduce cost without introducing inefficiencies from separate designs.

The design of the exemplary canisters 110 exhibits modularity. With separate wall extrusions 220 joined by corner extrusions 230 controlled through mechanical interface requirements, a customized canister 110 can be assembled with reusable components and minimum new or custom components to contain missiles or payloads of various sizes, thereby enabling scalability needed to accommodate non-axisymmetric cross-section designs, such as lifting-bodies. This reduces qualification requirements as compared to conventional multiple canisters for the same missile via the exemplary modular canister 110, yielding lower cost.

The electronics module 140 at the aft end of the canister 110 provides space for mechanical and/or electrical interfaces that can include standardized configurations. Such capability provides greater plug-and-play installation with more universal hardware design protocols. The housing 620 also provides for separate instrumentation away from package control circuits and a power source to monitor canister security from tampering and internal environmental conditions—a matter of concern in the wake of the fatal cook-off incident aboard USS Forrestal (CV-59) in 1967.

Bolted design enables ease of assembly and disassembly. Swappable parts, without excessive bolting, means easier maintenance and flexibility. This includes: separating the sides into multiple parts—e.g., two corner extrusions 230 with a wall extrusion 220, which facilitates flexibility and scalability to transform the chamber for different shapes. Common sizing and defined mechanical interface rules enable a simplified platform 630 to host the launch assembly 680 of various canisters 110. Canted edges 130 inhibit damage and offer double the attachment area rather than only a single side or corner. The ability to attach canisters 110 together and to the panel 635 simplifies the platform 630 configuration and permits different sizes to be assembled together.

The canisters 110 are preferably constructed from aluminum for high strength-to-weight ratio, self-preservation in corrosive environments, and heat dissipation to protect adjacent cells and internal components (e.g., electronics, wiring), although other materials may depend on requirements and manufacturability. Weight reduction of the exemplary launcher system renders the design more accessible to more platforms and increase munition payload/mission capability. The concept, being scalable, has evolved into a couple of primary sizes based on available and expected munitions for PEO Marine: Small 110-9"×9"×48"; ~85 lbs. Medium 730-9"×9"×72"; ~120 lbs. Large 740-12"×12"×96". Extra Large 750-18"×18"×120".

The wall extrusion 220 incorporates symmetry and a pair of hollow regions that flank the channel 420 can be used for cabling, sensors, insulation, etc. This enables from one-to-four interior rails 310 to be used, augmenting flexibility for payloads and mounting. The design uses standardized thread sizes and spacing sets a standard for design integration. Overall ¼" thick 6061 aluminum alloy for a small and medium size launcher provides ballistic protection and serves as a heat sink.

The exemplary cross-section profile of the canister 110 is transformable to enable different missiles to be inserted into the interior 170 with varying shape and size. Missile inventory since the 1960s follows a length-to-diameter ratio range of between 8:1 and 12:1 standard launcher spacing and size, which can be readily accommodated by the exemplary modular design.

The corner extrusion 230 incorporates gasket seams to enable the corner and wall extrusions 230 and 220 to be sealed to each other for weather tightness and EMI upon being bolted together. External environmental conditions to seal against include humidity, vibration and ambient temperature. Standardized thread sizes and spacing sets a standard for design integration. Oversized slots covered and sealed by the exterior rail 280 render bolting of the extrusions 220 and 230 readily accessible. The canted edge mount of 45° (=π/4 radian) the exterior rail 280 removes sharp corners and enables the corner to be grabbed from either adjacent or tangent external face from only one side.

The exterior and interior rails 270 and 310 are configurable to the platform and munitions. An L-track cross-section was selected for the exterior rail 270 to exploit its strength qualities, ease to acquisition and purchase, and general acceptance in the aircraft and freight industry for tie-downs. Different attachments are commercially available—to this effect the Picatinny Rail was selected for the interior rail 310 because of flexibility and availability. Any rail type that accommodates 5/16" countersunk bolts on 3" centers, or as defined by subsequent requirements, can be incorporated, assuming compatibility with the platform 630 and the munition.

One-to-four interior rails 310 can be installed based on need to reduce weight and cost. Most missiles and payloads only require one each. The exterior rails 280 facilitate external attachments to the canister 110 without the necessity of handles. An operator can simply slide a handle attachment into the rail and lock in the device to move the canister 110 or other equipment for the system, including cameras, weather equipment. Fire control or other electronics gear, can be directly attached to the canister 110.

The breech 260, launcher door 150, and covers 250 and 270 each contain channels for gaskets, some double, for weather-tightness and EMI. Coupled with the corner extrusion 230, the selection of these covers as gaskets, using simple milled aluminum pieces, reduces cost and complexity of incorporating environmental protection.

The electro-mechanical actuator 330 enables a strong, responsive all-electric design with positive location awareness of the actuator's position and thus the status of the door 150 as open or closed. For security, by default the actuator 330 can be set to lock the door 150 closed in the absence of applied electric power. The design also enables other actuation types such as servos or other actuators (hydraulic, pneumatic, etc.), providing greater flexibility and more configuration options.

The electronics module 140 provides a removable end cap containing interface and control systems for the canister 110. The electronics module 140 includes munition cards that can communicate over common protocols based on common standards (IEEE-1553, RS-432, RS-232, Ethernet, etc.), but restricts outputs to the external connector by Ethernet. This enables munitions to select the mode and content of communication, with the message converted and simplified to a single interface, protocol, and language back to fire control and operators.

The breech cover 250 enables the exemplary canister 110 to maintain a sealed against weather and electro-magnetic interference container for the payload while separated from the electronics module 140. This enables the electronics module 140 to be separated from the canister 110 to be repaired or upgraded at a separate location from the canister 110.

Munition cards (with control processors and memory) in the electronics module 140 typically accept standard 28 $V_{DC}$ and can be converted to other usable voltages. These cards employ air-gap and solid state relays as required to control and launch munitions. The electronics module 140 can incorporate a suite of monitoring and security sensors with a MIL-spec battery for continuous monitoring and replacement. Completely separate from the munition and firing path, such equipment in the electronics module 140 and the separate munition cards can facilitate certification while improving system awareness physical tampering, based on position of the door 150.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A modular canister for containing a missile for launch, said canister comprising:

a set of four longitudinal assemblies attachable to form a rectangular cross-section chamber between fore and aft ends, each assembly including a wall extrusion and a corner extrusion that connect together along longitudinal edges;

an electronics module that connects to said chamber at said aft end; and a hatch module that connects to said chamber at said fore end, said hatch module including an aperture cover, a door and a hinge, wherein said door pivots on said hinge between a default closed position and a command open position, and said chamber can receive or else launch the missile through said aperture cover when said door is in said open position.

2. The canister according to claim 1, wherein said each longitudinal assembly further includes an external rail that attaches to said corner extrusion.

3. The canister according to claim 2, wherein said external rail includes a Picatinny rail.

4. The canister according to claim 3, wherein said Picatinny rail attaches to at least one of auxiliary equipment and an adjacent canister.

5. The canister according to claim 1, wherein said each longitudinal assembly further includes an internal rail that attaches to said corner extrusion.

6. The canister according to claim 1, wherein opposite facing wall extrusions have substantially equal widths.

7. The canister according to claim 1, wherein said electronics module includes a closed four-sided frame coaxial to said chamber flanked by front and rear cap panels.

8. The canister according to claim 1, wherein said hinge can pivot said door by an actuator.

9. The canister according to claim 1, wherein said wall and corner extrusions are composed of aluminum alloy.

10. The canister according to claim 1, wherein said wall extrusion includes a channel facing said chamber.

11. The canister according to claim 1, further including a bulkhead panel to separate said electronics module and said chamber.

* * * * *